US011109688B2

(12) United States Patent
Choi

(10) Patent No.: US 11,109,688 B2
(45) Date of Patent: Sep. 7, 2021

(54) REGIMEN MATTRESS

(71) Applicant: Inno-Sports Co., Ltd, Xiamen (CN)

(72) Inventor: Kwan Jun Choi, Xiamen (CN)

(73) Assignee: Inno-Sports Co., Ltd, Xiamen (CN)

( * ) Notice: Subject to any disclaimer, the term of this patent is extended or adjusted under 35 U.S.C. 154(b) by 193 days.

(21) Appl. No.: 15/965,852

(22) Filed: Apr. 28, 2018

(65) Prior Publication Data

US 2019/0320810 A1 Oct. 24, 2019

(30) Foreign Application Priority Data

Apr. 20, 2018 (CN) ..... 201810359126.6
Apr. 20, 2018 (CN) ..... 201820570159.0

(51) Int. Cl.

*A47C 27/14* (2006.01)
*A47C 31/10* (2006.01)
*A47C 21/04* (2006.01)
*A47C 31/00* (2006.01)

(52) U.S. Cl.

CPC ..... *A47C 27/148* (2013.01); *A47C 21/048* (2013.01); *A47C 31/105* (2013.01); *A47C 31/001* (2013.01); *A47C 31/005* (2013.01)

(58) Field of Classification Search

CPC ..... A47C 27/148; A47C 27/14; A47C 27/20; A47C 31/105; A47C 31/005; A47C 31/001; A47C 21/048; A47C 27/142; A47C 27/144; A61G 7/05715

See application file for complete search history.

(56) References Cited

U.S. PATENT DOCUMENTS 3,987,507 A * 10/1976 Hall ..... A47C 7/18 5/653
5,086,530 A * 2/1992 Blake ..... A47C 27/005 5/484
5,960,496 A * 10/1999 Boyd ..... A47C 27/144 5/722
8,918,935 B2 * 12/2014 Gladney ..... A47C 27/148 5/730
10,368,654 B2 * 8/2019 Sopher ..... A47C 21/028
2005/0039264 A1 * 2/2005 Barman ..... A47C 27/056 5/717
2007/0289069 A1 * 12/2007 Wells ..... A47C 27/15 5/727
2008/0307583 A1 * 12/2008 Oh ..... A47C 27/14 5/740

(Continued)

FOREIGN PATENT DOCUMENTS

CN 205568446 U 9/2016
WO WO-2005099520 A1 * 10/2005 ..... A47C 27/001

OTHER PUBLICATIONS

Ritesh Tiwari, Global and China Polyurethane Industry Chain (MDI, TDI & PPG) Report 2014-2017, 2017, China Market Research Reports p. 1-3 (Year: 2017).*

*Primary Examiner* — Robert G Santos
*Assistant Examiner* — Alison N Labarge
(74) *Attorney, Agent, or Firm* — Bayramoglu Law Offices LLC

(57) ABSTRACT

The present invention relates to a regimen mattress. The regimen mattress includes a layer. The layer includes at least a cavity having an opening. At least a function foam block or a replaceable foam block is disposed in the cavity through the opening.

7 Claims, 3 Drawing Sheets

(56) References Cited

U.S. PATENT DOCUMENTS

| | | | | |
|---|---|---|---|---|
| 2009/0043595 | A1* | 2/2009 | Rawls-Meehan | A47C 31/126 705/300 |
| 2014/0082843 | A1* | 3/2014 | Papadakos | A47C 19/021 5/618 |
| 2014/0289968 | A1* | 10/2014 | Van der Velde | A47C 27/005 5/716 |
| 2017/0156508 | A1* | 6/2017 | Segal | A47C 27/001 |
| 2018/0020837 | A1* | 1/2018 | Cheng | A47C 7/18 297/452.42 |
| 2019/0038043 | A1* | 2/2019 | Fisher | A47C 27/148 |
| 2019/0150632 | A1* | 5/2019 | Pearce | A47C 27/06 |

* cited by examiner

REGIMEN MATTRESS

CROSS REFERENCE TO RELATED APPLICATIONS

This application is based upon and claims priority to Chinese Patent Application No. 201810359126.6, filed on Apr. 20, 2018 and No 201820570159.0, filed on Apr. 20, 2018, the entire contents of which are incorporated herein by reference.

TECHNICAL FIELD

The present invention relates to the technical field of mattress, particularly to a regimen mattress.

BACKGROUND OF THE INVENTION

With the improvement of people's living standards, more and more people are becoming health-conscious. However, people having lifestyle diseases may feel quite uncomfortable based on the stage of illness. Health care products are offered to help people with diseases. Mattresses, as an indispensable necessity, are used in daily life such that people contact with during the use of them. Functional design of mattresses has become more important as people pay more attention to products that are healthier to use. Generally, the current functional mattresses include an entire functional foam formed by adding functional additives into raw materials. These mattresses hardly provide a long-term efficiency due to functional foam's irreplaceability. In addition, the full distribution of functional additives in a mattress foam leads to an increased cost. Therefore, it's necessary to develop a mattress that has a long service life with low cost.

SUMMARY OF THE INVENTION

The present invention provides a regimen mattress to solve the shortcomings of the prior art.

In order to achieve the above object of the invention, the following technical solution is provided.

The present invention provides a regimen mattress that including the layer. The layer includes cavity having opening, function foam block or replaceable foam block is disposed in the cavity through the opening.

Further, the layer is memory foam, the high density (HD) foam is disposed below the memory foam, and the cover covers the memory foam and the HD foam.

Further, the cavity is integrated foam molded with the memory foam, the plane where the opening lies is consistent with the top surface of the memory foam; the function foam block or the replaceable foam block matches the cavity.

Further, the depth of the cavity is less than the thickness of the memory foam. Further, the depth of the cavity is half of the thickness of memory foam.

Further, the shape of the cavity is regular, the cross section of the shape is selected from rectangle, square, circle, triangle or star.

Further, the shape of the cavity is irregular, the cross section of the shape is selected from heart, number or flower.

Further, the memory foam includes a plurality of cavities, the plurality of cavities are symmetrically arranged in a plurality of arrays on the memory foam.

Further, the function foam block and the replaceable foam block are detachable and replaceable; total number of the function foam block and the replaceable foam block used is equivalent to the number of the plurality of cavities.

Further, the cover includes first cover and second cover, the first cover is disposed on the top of the memory foam, the second cover is disposed around the side of the memory foam and the HD foam, and on the bottom of the HD foam; the first cover is detachably connected with the second cover, and the cover is detachably connected with the memory foam and the HD foam.

Further, each of the first cover and the second cover include inner cover and outer cover; the inner cover is made of a material selected from the group of fire retardant material or absorbing material; the outer cover is made of a material selected from the group of waterproof breathable material, heat conduction material or friction heating material; the inner cover and the outer cover are detachable and replaceable.

Further, the memory foam is made of diphenyl-methane-diisocyanate (MDI) and poly propylene glycol (PPG), the HD foam is made of 2,4-tolylene diisocyanate (TDI) and poly propylene glycol (PPG). Other combinations of materials can be used as well.

Further, the function foam block is formed by foam molding; the function foam block is made of diphenyl-methane-diisocyanate (MDI), poly propylene glycol (PPG) and a function additive.

Further, the function additive is tea additive or flower additive. Other function additives can be used as well.

Further, the tea additive is one or more selected from the group of green tea, black tea or white tea, the flower additive is one or more selected from the group of rose, jasmine, gardenia, lilac, orchid, aloe or camellia.

Further, the replaceable foam block is formed by foam molding; the replaceable foam block is made of diphenyl-methane-diisocyanate (MDI) and poly propylene glycol (PPG).

Further, the memory foam has a density ranging from 40D to 60D, the HID foam has a density ranging from 20D to 30D.

Further, the layer is top layer, the regimen mattress further includes bottom layer and four side borders; the top layer, the bottom layer and the four side borders are seamed together to form mattress frame; a plurality of springs are fixed connected between the top layer and the bottom layer.

Further, the top layer includes the memory foam and non-woven fabric, the memory foam and the non-woven fabric are seamed together; the cavity is disposed on the memory foam; the bottom layer includes first polyurethane (PU) foam and first non-woven fabric, the first PU foam and the first non-woven fabric are seamed together; the four side borders include second polyurethane (PU) foam and second non-woven fabric, the second PU foam and the second non-woven fabric are seamed together.

Further, the shape of the cavity is regular, the cross section of the shape is selected from rectangle, square, circle, triangle or star.

Further, the shape of the cavity is irregular, the cross section of the shape is selected from heart, number or flower.

Further, first cover is disposed on the top of the top layer, the first cover is detachably connected to the mattress frame; second cover is seamed with the bottom layer and the four sides borders.

Further, the memory foam includes a plurality of cavities, the plurality of cavities are symmetrically arranged in a plurality of arrays on the memory foam.

Further, the function foam block and the replaceable foam block are detachable and replaceable; total number of the function foam block and the replaceable foam block used is equivalent to the number of the plurality of cavities.

Further, the cavity is integrated foam molded with the memory foam, the plane where the opening lies is consistent with the top surface of the memory foam; the function foam block or the replaceable foam block matches the cavity.

Further, the replaceable foam block is formed by foam molding; the memory foam and the replaceable foam block are made of diphenyl-methane-diisocyanate (MDI) and poly propylene glycol (PPG). Other combinations of materials can be used as well.

Further, the function foam block is formed by foam molding; the function foam block is made of diphenyl-methane-diisocyanate (MDI), poly propylene glycol (PPG) and a function additive. Other combinations of materials can be used as well.

Further, the function additive is tea additive or flower additive. Other function additives can be used as well.

Further, the tea additive is one or more selected from the group of green tea, black tea or white tea, the flower additive is one or more selected from the group of rose, jasmine, gardenia, lilac, orchid, aloe or camellia.

Compared with the prior art, the advantages of the present invention are as follows. Regimen mattress of the present invention uses a plurality of function foam blocks to greatly reduce the production cost due to the reduction of the usage of the expensive function additives. At the same time, the function foam blocks and replaceable foam blocks are detachable and replaceable, which not only ensures the effect of regimen mattress, but also makes it a common mattress when the function foam blocks are not in use, thus prolonging mattress's service life.

DETAILED DESCRIPTION OF THE INVENTION

The present invention will be further described below in detail with reference to the accompanying drawings and embodiments. However, it should be clear that the specific embodiments described herein are used only to explain the present invention, and are not intended to limit the scope of the invention.

Figure 1:
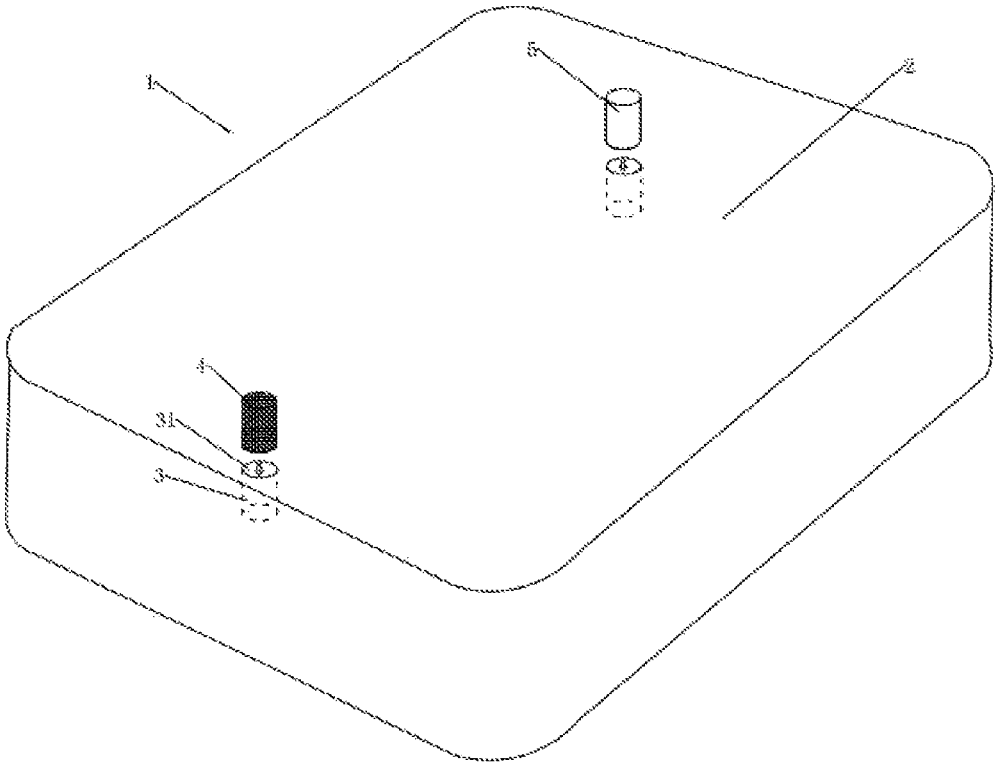
FIG. 1 is a schematic diagram of a regimen mattress according to the first embodiment of the present invention.

Referring to FIG. 1, a schematic diagram of a first embodiment of the regimen mattress of the present invention is shown. The regimen mattress 1 includes the layer 2. The layer 2 includes cavity 3 having opening 31, function foam block 4 or replaceable foam block 5 is disposed in the cavity 3 through the opening 31. The layer 2 can be memory foam 21 or top layer 22 of the following embodiments of the present invention.

Figure 2:
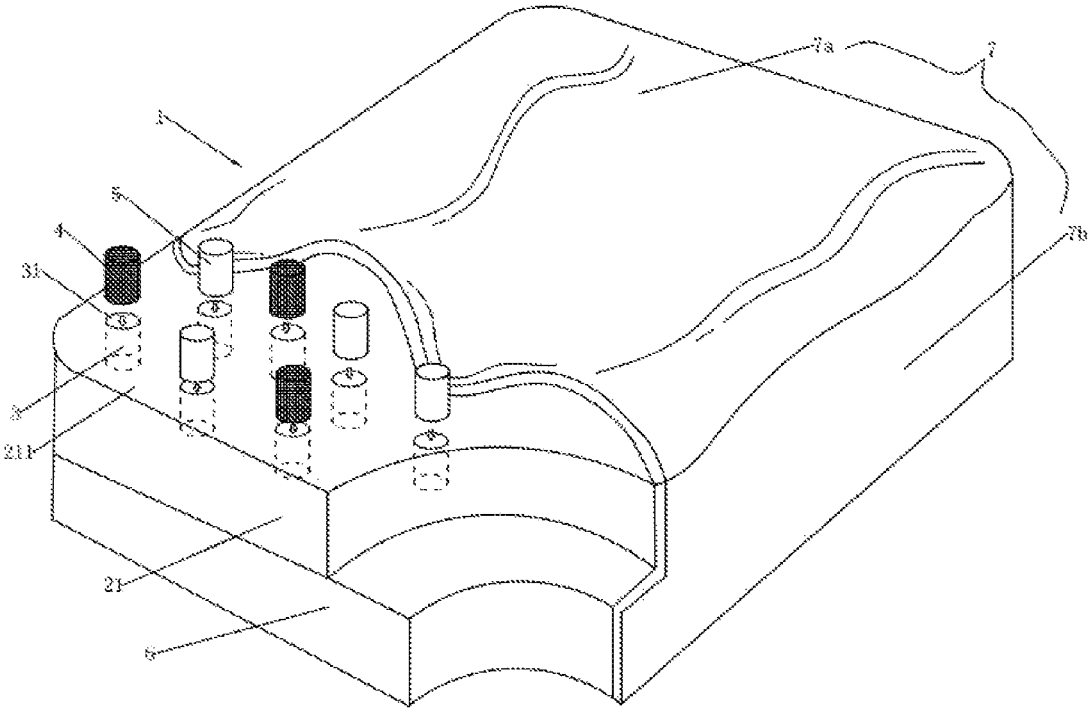
FIG. 2 is a schematic diagram of a regimen mattress according to the second embodiment of the present invention.

Referring to FIG. 2, a schematic diagram of a second embodiment of the regimen mattress of the present invention is shown. The regiment mattress 1 includes memory foam 21, high density (HD) foam 6 below the memory foam 21, and cover 7 covering memory foam 21 and HD foam 6 together to form regimen mattress 1. Memory foam 21 includes cavity 3, the cavity 3 is integrated foam molded with the memory foam 21 by concaving inward the memory foam 21, the cavity 3 is provided with opening 31, the plane where the opening 31 lies is consistent with top surface 211 of the memory foam 21. Function foam block 4 or replaceable foam block 5 is disposed in the cavity 3 through the opening 31, and function foam block 4 or replaceable foam block 5 matches the cavity 3. Depth of cavity 3 is equal to the thickness of memory foam 21 or less than the thickness of memory foam 21, preferably, depth of cavity 3 is half of the thickness of memory foam 21.

The cover 7 includes first cover 7*a* and second cover 7*b*, the first cover 7*a* is disposed on top of the memory foam 21, the second cover 7*b* is disposed around side of the memory foam 21 and the HD foam 6, and on bottom of the HD foam 6; the first cover 7*a* is detachably connected with the second cover 7*b*, and the cover 7 is detachably connected with memory foam 21 and HD foam 6. Preferably, the first cover 7*a* is connected to the second cover 7*b* through zipper.

Figure 3:
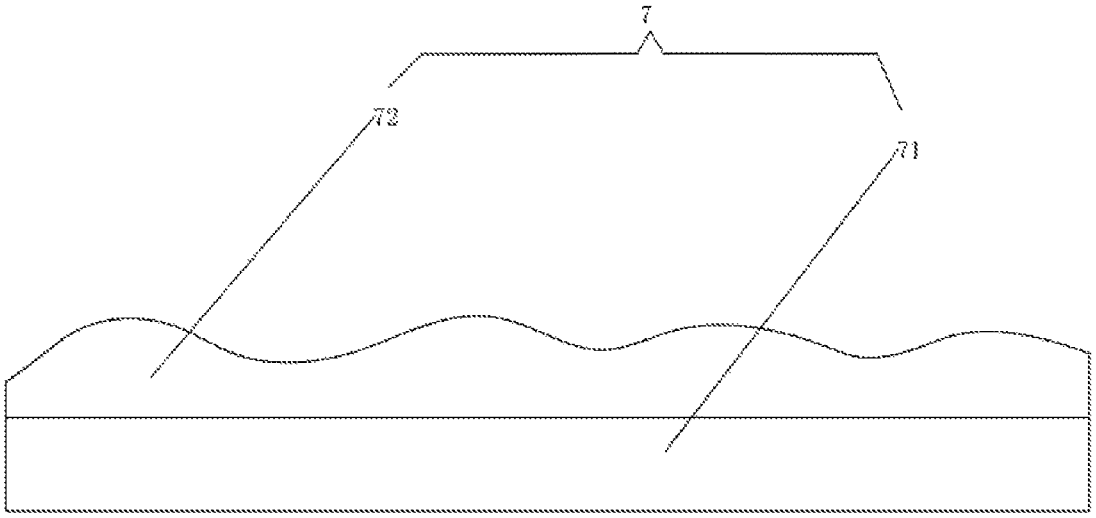
FIG. 3 is a section view of the structure of cover.

The first cover 7*a* and second cover 7*b* both include inner covers 71 and outer covers 72, as shown in FIG. 3. Design of the two-layer cover, together with the selection of the materials, can achieve different functions of the mattress. The inner covers 71 are made of the material selected from the group of fire retardant material or absorbing material. The use of fire retardant material for inner cover 71 can ensure adequate security. While the use of absorbing material for inner cover 71, such as the activated carbon, can effectively absorb bacteria and odor deposited in memory foam 21 or HD foam 6, thus keeping the mattress clean. The outer covers 72 are made of the material selected from the group of waterproof breathable material, heat conduction material or friction heating material. The use of waterproof breathable material for outer cover 72 is beneficial to the volatilization of the additives in function foam blocks 4, making the additives spread to the air. The use of heat conduction material or friction heating material for outer cover 72 makes the additives in function foam blocks 4 easier to evaporate to the air due to the heat generated directly from the user or the heat produced by the rubbing between the user and outer cover 72 that is transferred to memory foam 21. This heat transfer speeds up the molecular motion in additives. The inner cover 71 and the outer cover 72 are detachable and replaceable.

Figure 4:
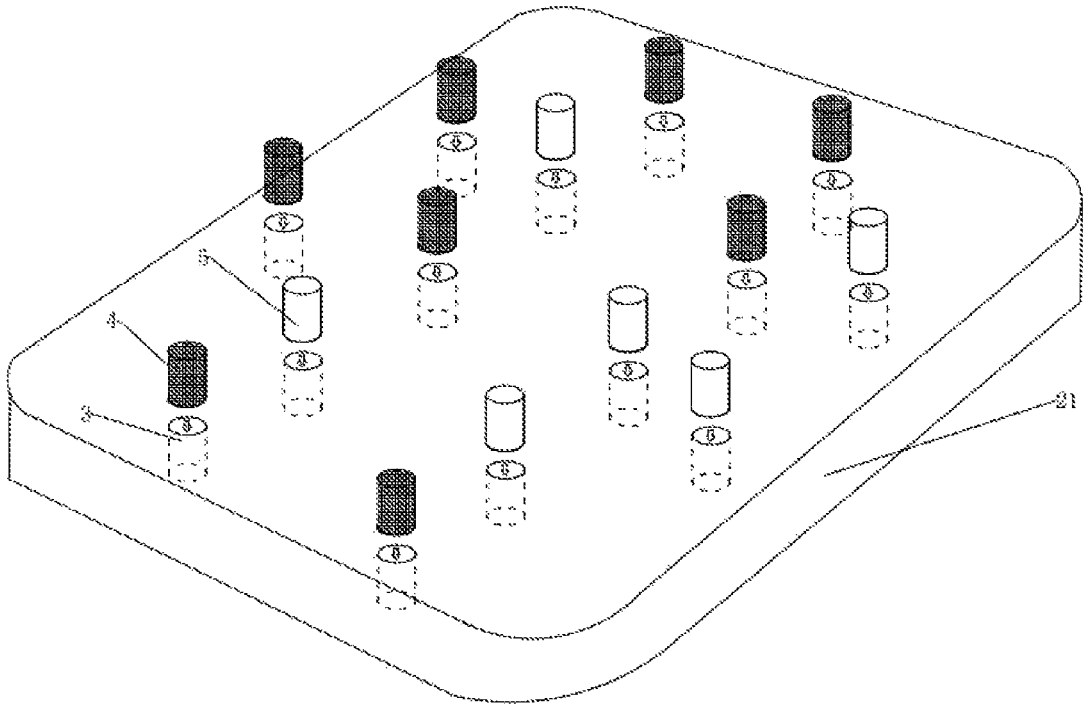
FIG. 4 is a schematic diagram of a memory foam according to the third embodiment of the present invention.

Referring to FIG. 4, a third embodiment of the present invention is shown. In the third embodiment, the structure of the third embodiment is similar to the structure of the second embodiment, the only difference is that the memory foam 21 of the third embodiment includes a plurality of cavities 3, the plurality of cavities 3 are symmetrically arranged in a plurality of arrays on the memory foam 21. Shape of the cavity 3 is regular or irregular, cross section of the shape is selected from rectangle, square, circle, triangle, star, heart, number or flower. Other shapes can be used as well. Function foam block 4 and replaceable foam block 5 are detachable and replaceable; total number of the function foam block 4 and the replaceable foam block 5 used is equivalent to number of the plurality of cavities 3. However, it is also possible that total number of the function foam block 4 and the replaceable foam block 5 used is less than the number of the plurality of cavities 3. In that arrangement there may be number of cavities without function foam block 4 or replaceable foam block 5. Due to the existing of cavities 3 on memory foam 21, matched function foam blocks 4 or replaceable foam blocks 5 can be put into or taken out of mattress 1 conveniently at any time when necessary. Function foam blocks 4 or replaceable foam blocks 5 matches cavity 3 ensuring the comfortable feeling without any foreign body sensation. What's more, the symmetrical design simultaneously meets different requirements of different persons, for example, a wife can choose to use function foam blocks 4 or replaceable foam blocks 5 in her side, at the same time, a husband can choose to use function foam blocks 4 or replaceable foam blocks 5 in his side. While the symmetrical design is used in this embodiment, it is possible to have a structure where the design of distribution of cavities is not symmetrical.

In above listed embodiments, memory foam 21 is made of diphenyl-methane-diisocyanate (MDI) and poly propylene glycol (PPG), HD foam 6 is made of 2,4-tolylene diisocyanate (TDI) and poly propylene glycol (PPG). Other combinations of materials can be used as well.

Function foam block 4 is formed by foam molding; function foam block 4 is made of diphenyl-methane-diisocyanate (MDI), poly propylene glycol (PPG) and a function additive. Other combinations of materials can be used as well. Function additive is tea additive or flower additive. Other function additives can be used as well. Tea additive is one or more selected from the group of green tea, black tea or white tea, flower additive is one or more selected from the group of rose, jasmine, gardenia, lilac, orchid, aloe or *camellia.*

Replaceable foam block 5 is formed by foam molding; replaceable foam block 5 is made of diphenyl-methane-diisocyanate (MDI) and poly propylene glycol (PPG). Other combinations of materials can be used as well.

Preferably, memory foam 21 has density ranging from 40D to 60D, HD foam 6 has density ranging from 20D to 30D; more preferably, memory foam 21 has density ranging from 40D to 42D.

Figure 5:
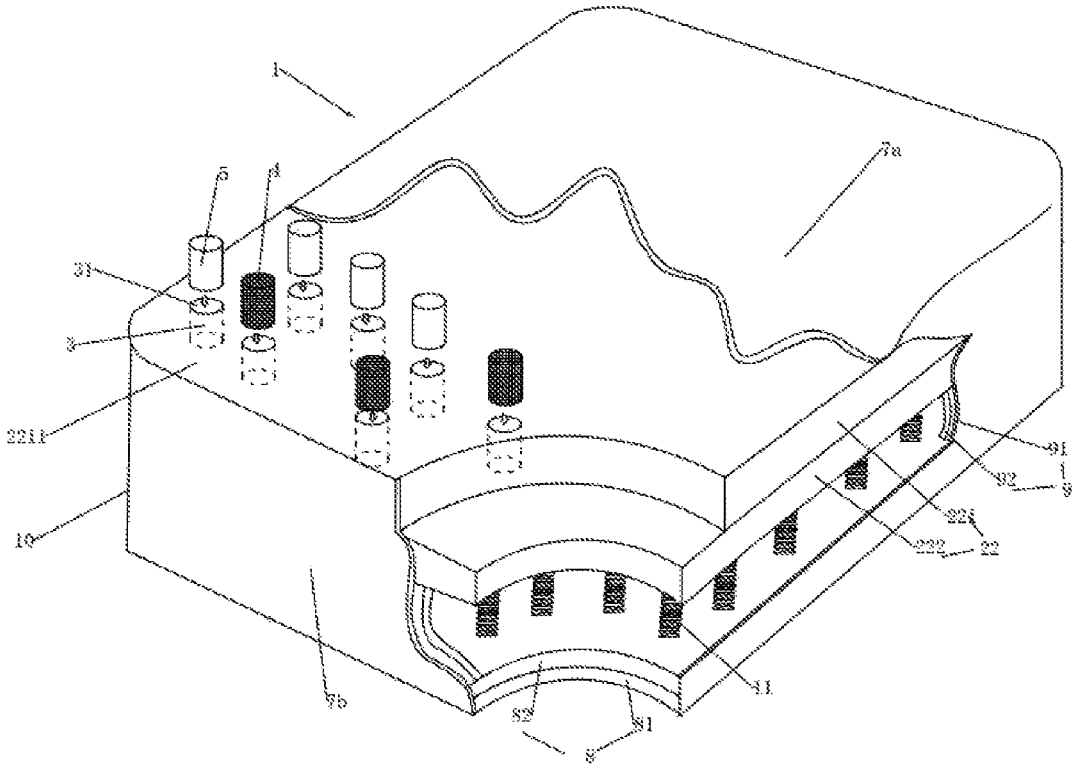
FIG. 5 is a schematic diagram of a regimen mattress according to the fourth embodiment of the present invention.

A fourth embodiment of regimen mattress of the present invention is shown in FIG. 5. The regimen mattress 1 includes top layer 22, bottom layer 8, four side borders 9, first cover 7*a* is disposed on top of top layer 22, second cover 7*b* is disposed on bottom layer 8 and four side borders 9. Top layer 22, bottom layer 8 and four borders 9 are seamed together to form mattress frame 10; a plurality of springs 11 are fixed connected between top layer 22 and bottom layer 8. The second cover 7*b* is seamed with the bottom layer 8 and the four side borders 9 to form an integrated formed structure.

Top layer 22 includes memory foam 221 and non-woven fabric 222, memory foam 221 and non-woven fabric 222 are seamed together; cavity 3 is disposed on the memory foam 221; bottom layer 8 includes first polyurethane (PU) foam 81 and first non-woven fabric 82, the first PU foam 81 and the first non-woven fabric 82 are seamed together; four side borders 9 includes second polyurethane (PU) foam 91 and second non-woven fabric 92, the second PU foam 91 and the second non-woven fabric 92 are seamed together.

Memory foam 221 includes cavity 3, the cavity 3 is integrated foam molded with the memory foam 221 by concaving inward the memory foam 221, the cavity 3 is provided with opening 31, the plane where the opening 31 lies is consistent with top surface 2211 of the memory foam 221; function foam block 4 or replaceable foam block 5 is disposed in the cavity 3 through the opening 31, and the function foam block 4 or the replaceable foam block 5 matches the cavity 3.

First cover 7*a* is detachably connected to the mattress frame 10; function foam block 4 and replaceable foam block 5 are detachable and replaceable. Preferably, first cover 7*a* is connected to the mattress frame 10 through zipper.

In a fifth embodiment of the present invention, the structure of the fifth embodiment is similar to the structure of the fourth embodiment, the only difference is that the memory foam 221 of the fifth embodiment includes a plurality of cavities 3, the plurality of cavities 3 are symmetrically arranged in a plurality of arrays on the memory foam 221. Shape of the cavity 3 is regular or irregular, cross section of the shape is selected from rectangle, square, circle, triangle, star, heart, number or flower. Other shapes can be used as well. Function foam block 4 and replaceable foam block 5 are detachable and replaceable. Total number of the function foam block 4 and the replaceable foam block 5 used is equivalent to number of the plurality of cavities 3. However, it is also possible that total number of the function foam block 4 and the replaceable foam block 5 used is less than the number of the plurality of cavities 3. In this arrangement there may be number of cavities without function foam block 4 or replaceable foam block 5. Due to the existing of cavities 3 on memory foam 221, matched function foam blocks 4 or replaceable foam blocks 5 can be put into or taken out of memory foam 221 conveniently at any time when necessary. Function foam blocks 4 or replaceable foam blocks 5 matches cavity 3 ensuring the comfortable feeling without any foreign body sensation. What's more, the symmetrical design simultaneously meets different requirements of different persons, for example, a wife can choose to use function foam blocks 4 or replaceable foam blocks 5 in her side, at the same time, a husband can choose to use function foam blocks 4 or replaceable foam blocks 5 in his side. While the symmetrical design is used in this embodiment, it is possible to have a structure where the design of distribution of cavities is not symmetrical.

In above listed embodiments, replaceable foam block 5 is formed by foam molding; the memory foam 221 and replaceable foam block 5 are made of diphenyl-methane-diisocyanate (MDI) and poly propylene glycol (PPG). Other combinations of materials can be used as well.

Function foam block 4 is formed by foam molding; function foam block 4 is made of diphenyl-methane-diisocyanate (MDI), poly propylene glycol (PPG) and a function additive. Other combinations of materials can be used as well.

Function additive is tea additive or flower additive. Other function additives can be used as well. Tea additive is one or more selected from the group of green tea, black tea or white tea, flower additive is one or more selected from the group of rose, jasmine, gardenia, lilac, orchid, aloe or camellia.

The present invention puts function foam block into memory foam instead of foaming the whole mattress foam to greatly reduce the production cost due to the reduction of the usage of the expensive function additives. At the same time, the function foam block and replaceable foam block are detachable and replaceable, which not only ensures the effect of regimen mattress, but also makes it a common mattress when the function foam blocks are not in use, thus prolonging mattress's service life.

The foregoing descriptions are merely preferred embodiments of the present invention, and are not used to limit the scope of the present invention. Any modifications, equivalent replacements and improvements made within the spirit and principle of the present invention should be included in the protection scope of the present invention.

What is claimed is:

1. A regimen mattress comprising:

a top layer including a memory foam layer and a first non-woven fabric located under the memory foam layer, a bottom layer, four side borders, and a cover;

wherein the memory foam layer and the first non-woven fabric are seamed together, the memory foam layer comprises a plurality of cylindrically shaped cavities;

the bottom layer comprises a first polyurethane (PU) foam and a second non-woven fabric, the first PU foam and the second non-woven fabric are seamed together; the four side borders comprise a second polyurethane (PU) foam and a third non-woven fabric, the second PU foam and the third non-woven fabric are seamed together;

the top layer, the bottom layer and the four side borders are seamed together to form a mattress frame, and a plurality of springs are fixed connected between the top layer and the bottom layer;

the cover wraps the mattress frame, the cover comprises an inner cover and an outer cover, the inner cover is made of a fire retardant material or an absorbing material; the outer cover is made of a waterproof breathable material, a heat conduction material or a friction heating material; the inner cover and the outer cover are detachable and replaceable; and a cylindrically shaped function foam block and a cylindrically shaped replaceable foam block are removably disposed in the plurality of cylindrically shaped cavities;

wherein the cylindrically shaped function foam block and the memory foam layer are made from a different combination of materials, wherein the cylindrically shaped function foam block is made of diphenyl-methane-diisocyanate (MDI), poly propylene glycol (PPG) and a function additive and the memory foam layer is made of diphenyl-methane-diisocyanate (MDI) and poly propylene glycol (PPG); and the cylindrically shaped replaceable foam block and the memory foam layer are made from a same combination of materials, where the cylindrically shaped replaceable foam block is made of diphenyl-methane-diisocyanate (MDI) and poly propylene glycol (PPG) and the memory foam layer is made of diphenyl-methane-diisocyanate (MDI) and poly propylene glycol (PPG).

2. The regimen mattress of claim 1, wherein the plurality of cylindrically shaped cavities are symmetrically arranged in a plurality of arrays on the memory foam layer, the arrays comprise the cylindrically shaped cavities located in a longitudinal plane and a horizontal plane relative to an axis of the memory foam layer.

3. The regimen mattress of claim 1, wherein the cover comprises a first cover and a second cover, the first cover is disposed on a top of the top layer, and the second cover is disposed around a side of the top layer and the four side borders and on a bottom of the bottom layer; the first cover is detachably connected with the second cover, and the cover is detachably connected with the mattress frame.

4. The regimen mattress of claim 3, wherein the first cover and the second cover are connected through a zipper.

5. The regimen mattress of claim 1, wherein the function additive is a tea additive or a flower additive.

6. The regimen mattress of claim 1, wherein a depth of each of the cavities is less than a thickness of the memory foam layer.

7. The regimen mattress of claim 1, wherein a depth of each of the cavities is a half of a thickness of the memory foam layer.

* * * * *